US009016554B2

(12) United States Patent
Lee

(10) Patent No.: US 9,016,554 B2
(45) Date of Patent: Apr. 28, 2015

(54) PACKING BOX

(71) Applicant: Orion Corporation, Seoul (KR)

(72) Inventor: Hwa Kyung Lee, Seoul (KR)

(73) Assignee: Orion Corporation, Seoul (KR)

( * ) Notice: Subject to any disclaimer, the term of this patent is extended or adjusted under 35 U.S.C. 154(b) by 54 days.

(21) Appl. No.: 13/847,162

(22) Filed: Mar. 19, 2013

(65) Prior Publication Data

US 2014/0203070 A1 Jul. 24, 2014

(30) Foreign Application Priority Data

Jan. 18, 2013 (KR) ..... 20-2013-0000474 U

(51) Int. Cl.

*B65D 5/355* (2006.01)
*B65D 5/66* (2006.01)
*B65D 5/24* (2006.01)

(52) U.S. Cl.

CPC ..... *B65D 5/0005* (2013.01); *B65D 5/6635* (2013.01); *B65D 5/242* (2013.01); *Y10S 229/902* (2013.01)

(58) Field of Classification Search

USPC ..... 229/170, 902, 172, 138, 101
See application file for complete search history.

(56) References Cited

U.S. PATENT DOCUMENTS 567,649 A * 9/1896 Lanzit ..... 229/117.14
925,578 A * 6/1909 Haas ..... 229/138
3,542,569 A * 11/1970 Farquhar ..... 426/115
5,411,204 A * 5/1995 DeMay ..... 229/114

* cited by examiner

*Primary Examiner* — Christopher Demeree
(74) *Attorney, Agent, or Firm* — Ladas & Parry LLP

(57) ABSTRACT

Disclosed herein is a packing box in which the size and shape of an accommodation space are easily changeable to ensure convenient use of the contents. The packing box includes a rectangular bottom member and four sidewall members adapted to be erected at an outer perimeter of the bottom member, thereby defining an accommodation space having an open top. The sidewall members are divided into a pair of fixed sidewall members disposed facing each other to be vertically erected and fixed, and a pair of rotating sidewall members disposed facing each other between the fixed sidewall members to be inclined to an outside of the bottom member with respect to a vertical position thereof. The packing box includes at least one covering member to cover a gap between the fixed sidewall member and the rotating sidewall member when the rotating sidewalls are inclined.

5 Claims, 13 Drawing Sheets

PACKING BOX

CROSS-REFERENCE TO RELATED APPLICATION(S)

This application claims the benefit of Korean Utility Model Application No. 2012-0000474, filed on Jan. 18, 2013 in the Korean Intellectual Property Office, the disclosure of which is incorporated herein by reference.

BACKGROUND

1. Field

Embodiments of the present invention relate to a packing box in which size and shape of an accommodation space are easily changeable to ensure convenient use.

2. Description of the Related Art

Recently, a packing box formed of paper or synthetic resin film has entered widespread use for packing of simple food such as snacks.

Such a packing box is made by folding a sheet cut in a shape of an unfolded figure and fixing joints. Therefore, such a packing box is easy to fabricate and has a light weight, and thereby shipping expenses of a product may be reduced.

Korean Utility Model No. 20-0329249 illustrates an example of a packing box formed of paper to pack confectionery.

CITED REFERENCE

Patent Document

Korean Utility Model No. 20-0329249

SUMMARY

In conventional packing boxes, the fixed size of an accommodation space to accommodate contents may cause inconvenience of taking out the contents such as cookies from the open packing box and putting them in a separate vessel having a wide opening to allow several people to easily reach the same.

An accommodation space larger than the volume of contents to pack may be provided to the packing box to eliminate such inconvenience. However, in this case, the wide accommodation space may cause the contents to be excessively shaken in the accommodation space during transport and distribution, resulting in damage to the contents or other troubles.

Therefore, it is an aspect of the present invention to provide a packing box with an accommodation space whose size and shape are easily changeable to ensure convenient use of the contents.

Additional aspects of the invention will be set forth in part in the description which follows and, in part, will be obvious from the description, or may be learned from practice of the invention.

In accordance with one aspect of the present invention, a packing box including a rectangular bottom member and four sidewall members adapted to be erected at an outer perimeter of the bottom member and thereby defining an accommodation space having an open top, wherein the sidewall members are divided into a pair of fixed sidewall members disposed facing each other to be vertically erected and fixed, and a pair of rotating sidewall members disposed facing each other between the fixed sidewall members to be inclined to an outside of the bottom member with respect to a vertical position thereof, includes at least one covering member to cover a gap between the fixed sidewall member and the rotating sidewall member when the rotating sidewalls are inclined.

The covering member may be arranged to be vertically bent and extend from a lateral end of the rotating sidewall member toward the fixed sidewall member, the fixed sidewall member may be provided with a coupling portion, the covering member being slidably coupled to the coupling portion, and the covering member may be adapted to be stopped when the rotating sidewall member is inclined to a maximum inclinations angle.

Each of the fixed sidewall members may include an outer sidewall member bent upward from bottom member, and an inner sidewall member bent to extend from an end of the outer sidewall member to be folded toward an inner surface of the outer sidewall member, wherein a fixing hole is provided between the outer sidewall member and the bottom member, a fixing protrusion is provided at an end of the inner sidewall member to be fixed to the fixing hole, and the coupling portion is arranged between the outer sidewall member and the inner sidewall member.

An end of the fixing protrusion may penetrate the fixing hole and be bent to one side.

The covering member may include a first part directly connected to the rotating sidewall member and a second part extending from the first part, wherein the second part may include a stopping portion adapted to be held by an upper boundary between the inner side wall member and the outer side wall member when the rotating side wall member is inclined to the maximum inclination angle.

The second part may further include a bottom supported portion adapted to be supported by the bottom member when the rotating sidewall member is arranged perpendicular to the bottom member.

A folding guide line to guide folding of the covering member may be provided between the first part and second part of the covering member.

The covering member may be arranged to foldably connect lateral ends of the rotating sidewall member and the fixed sidewall member to each other.

The covering member may include a plurality of foldable members adapted to overlap each other when the rotating sidewall member is arranged perpendicular to the bottom member, wherein, one of the foldable members disposed closest to the rotating sidewall member may be adapted to adhere to an inner surface of the rotating sidewall member.

The packing box may further include a cover to open and close the open top of the accommodation space, and a locking part to lock the cover with the accommodation space closed, wherein rotation of the rotating sidewall member may be allowed when the cover is unlocked and be limited when the cover is locked.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
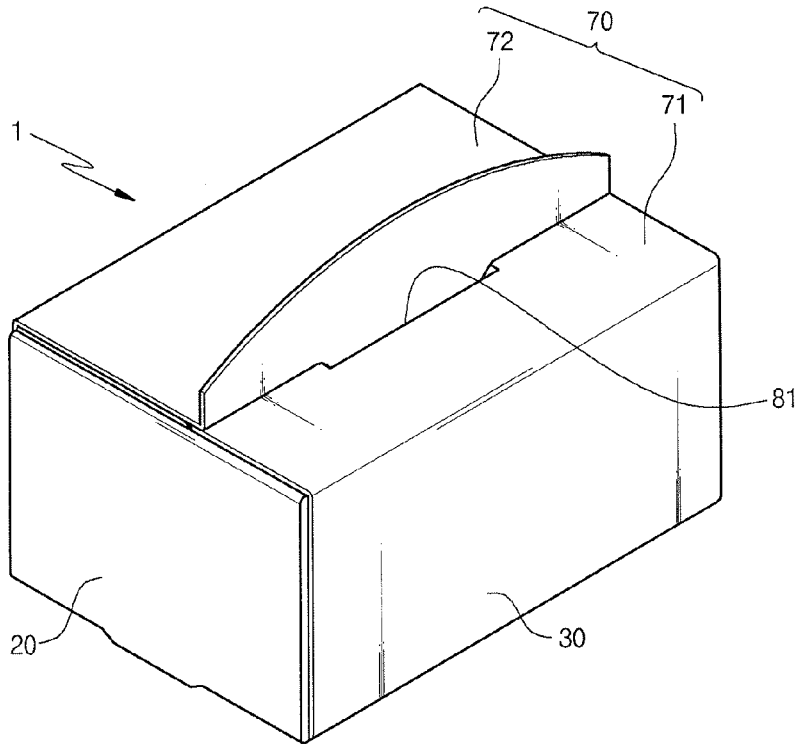
FIG. 1 is a perspective view illustrating a structure of a packing box according to an exemplary embodiment of the present invention, in which an accommodation space of the packing box is closed.

Reference will now be made in detail to the embodiments of the present invention, examples of which are illustrated in the accompanying drawings, wherein like reference numerals refer to like elements throughout.

FIGS. 1 to 6 illustrate a structure of a packing box 1 according to an exemplary embodiment of the present invention.

Figure 2:
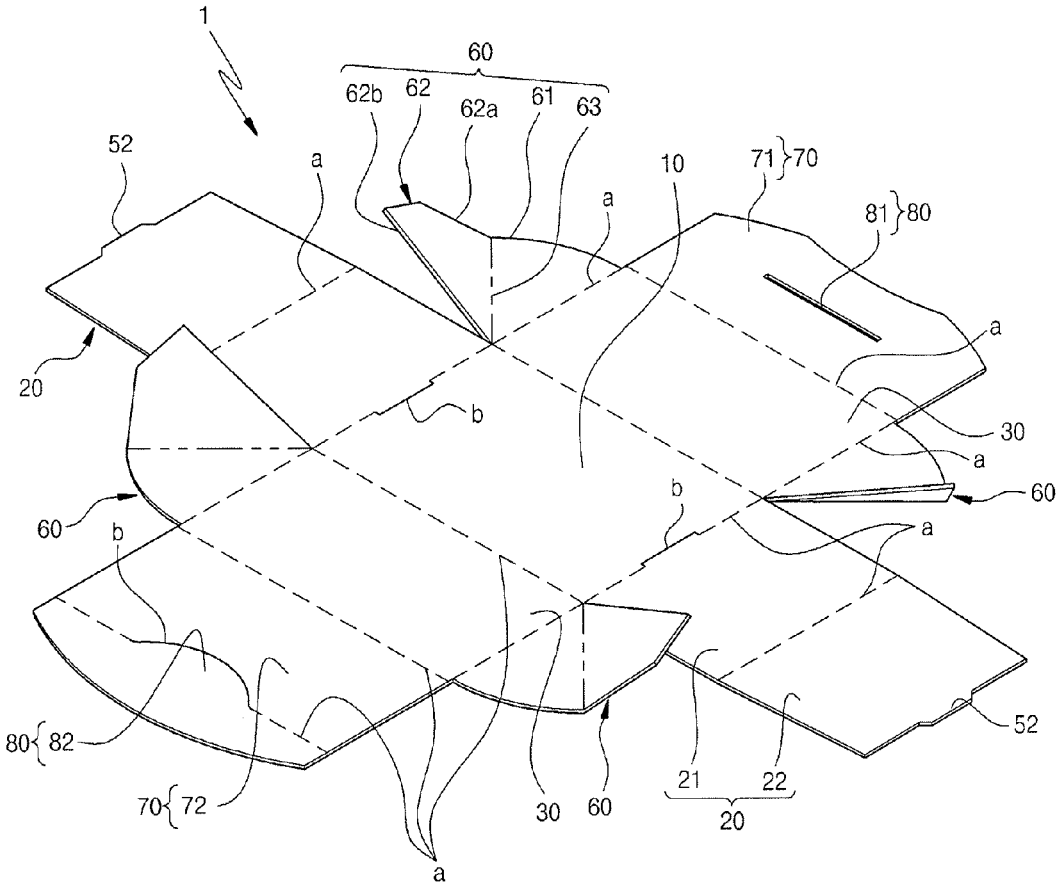
FIG. 2 is an exploded view illustrating the packing box of FIG. 1.

FIGS. 1 and 2 are a perspective view and exploded view illustrating the packing box 1 to be assembled according to the embodiment of the present invention.

The packing box 1, which is intended to pack contents such as snacks which come in small pieces, is formed of strawboard or thick paper. The packing box 1 may also be formed of a synthetic film which is flexible enough to be folded.

The packing box 1 of FIG. 1 is made by folding a sheet of paper cut in the form of a unfolded figure shown in FIG. 2. Reference symbol a shown in FIG. 2 indicates a folding line along which the sheet is folded to assemble the packing box. The folding line a presented in a dash line indicates the state in which the sheet is not folded yet, while the folding line a presented in a solid line indicates the state in which the sheet is folded. Reference symbol b represents a cut line along which the sheet is cut.

As shown in FIGS. 1 to 6, the packing box 1 includes a rectangular bottom member 10, and four sidewall members 20 and 30 erected at the perimeter of the bottom member 10. The inner space within the bottom member 10 surrounded by the four sidewall members 20 and 30 defines an accommodation space 40 with an open top to receive contents. The bottom member 10 may be formed in the shape of a square or a rectangle.

The sidewall members 20 and 30 are divided into a pair of fixed sidewall members 20 disposed facing each other to be vertically erected and fixed, and a pair of rotating sidewall members 30 positioned facing each other between the fixed sidewall members 20 to be rotated around the lower ends thereof from the vertically erected positions and inclined outward.

As the packing box 1 is formed of a flexible material, the fixed sidewall members 20 are not fully fixed when erected, but may be inclined to an extent when external force is applied thereto.

Each of the fixed sidewall members 20 is provided with an outer sidewall member 21 to be bent upward to vertically extend from the bottom member 10, and an inner sidewall member 22 arranged to extend from the end of the outer sidewall member 21 to be bent downward and folded toward the inner surface of the outer sidewall member 21. Thereby, each of the fixed sidewall members 20 has a double layer structure in which the outer surface thereof is formed by the outer sidewall member 21 and the inner surface thereof is formed by the inner sidewall member 22.

The outer sidewall member 21 and the inner sidewall member 22 have almost the same length. A fixing hole 51 is formed at the boundary between the outer sidewall member 21 and the bottom member 10, and a fixing protrusion 52 to be fitted into the fixing hole 51 and fixed is provided at the end of inner sidewall member 22 which forms a lower end when the inner side wall member 22 is folded to the outer side wall member 21. The fixing hole 51 is formed through the cut line b provided between the outer sidewall member 21 and the bottom member 10 when the outer sidewall member 21 is folded to stand with respect to the bottom member 10. Therefore, the fixed side wall members 20 is allowed to stay erected when the fixing protrusion 52 is fitted into the fixing hole 51 with the inner side wall member 22 folded toward the inner surface of the outer side wall member 21.

Figure 7:
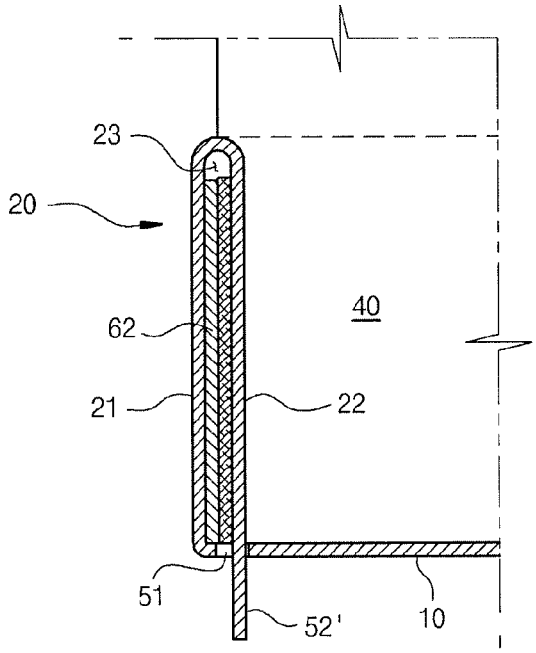
FIG. 7 is a cross-sectional view illustrating modification of a main part of the packing box of FIG. 1, in which a fixing protrusion of a fixed sidewall member is fitted into a fixing hole.
Figure 8:
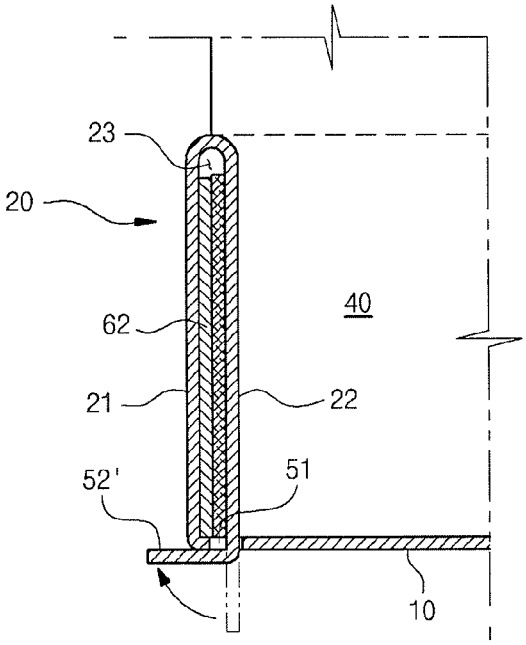
FIG. 8 is a view illustrating folding of the fixing protrusion of FIG. 7.

In the illustrated embodiment, the fixing protrusion 52 is a little longer than the thickness of the sheet forming the packing box 1 such that the fixing protrusion 52 is fitted into and held by the fixing hole 51. However, embodiments of the present invention are not limited thereto. As shown in FIGS. 7 and 8 illustrating a modification of main parts, the fixing protrusion 52 may have a longer length such that the fixing protrusion 52' is folded toward the bottom surface or outside of the bottom member 10 when fitted through the fixing hole 51. In this case, the strength of coupling the fixing protrusion 52' to the fixing hole 51 increases, thereby allowing the inner sidewall member 22 to stably remain folded to the outer sidewall member 21. Also, as the end of the fixing protrusion 52' is folded toward the bottom surface or outside of the bottom member 10, it does not prevent the packing box 1 from being stably sitting on the ground.

When the fixing protrusion 52 is inserted into the fixing hole 51, an open space running in a lateral direction is provided between the inner sidewall member 22 and the outer sidewall member 21 to form a coupling portion 23 to which covering members 60, which will be described later, are slidably coupled.

The covering members 60 slidably coupled to the coupling portion 23 are provided at both lateral ends of each rotating side wall member 30 to cover the gap between the rotating side wall members 30 and the fixed side wall members 20 which are inclined outward.

Figure 4:
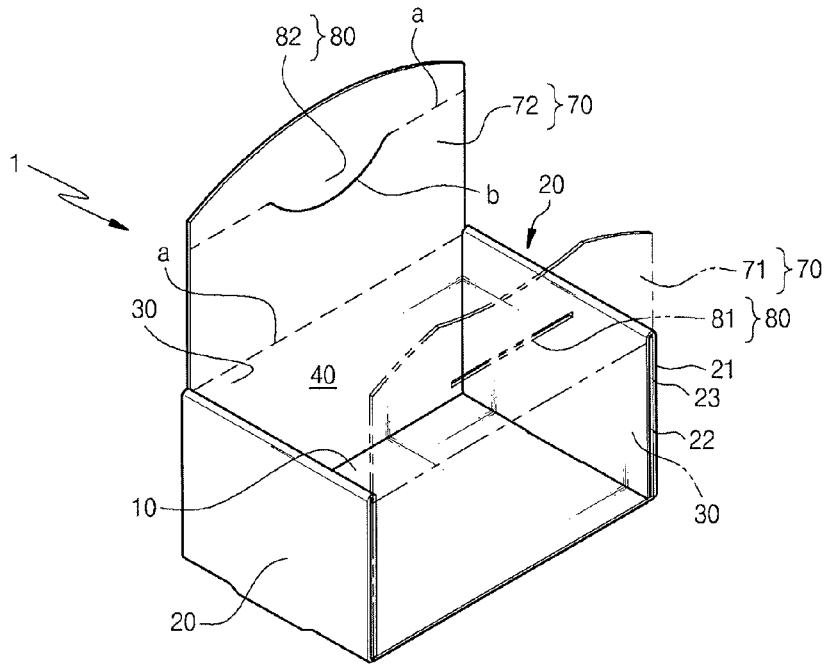
FIG. 4 is a perspective view illustrating the structure of the packing box of FIG. 1, in which rotating sidewall members are vertically erected.
Figure 5:
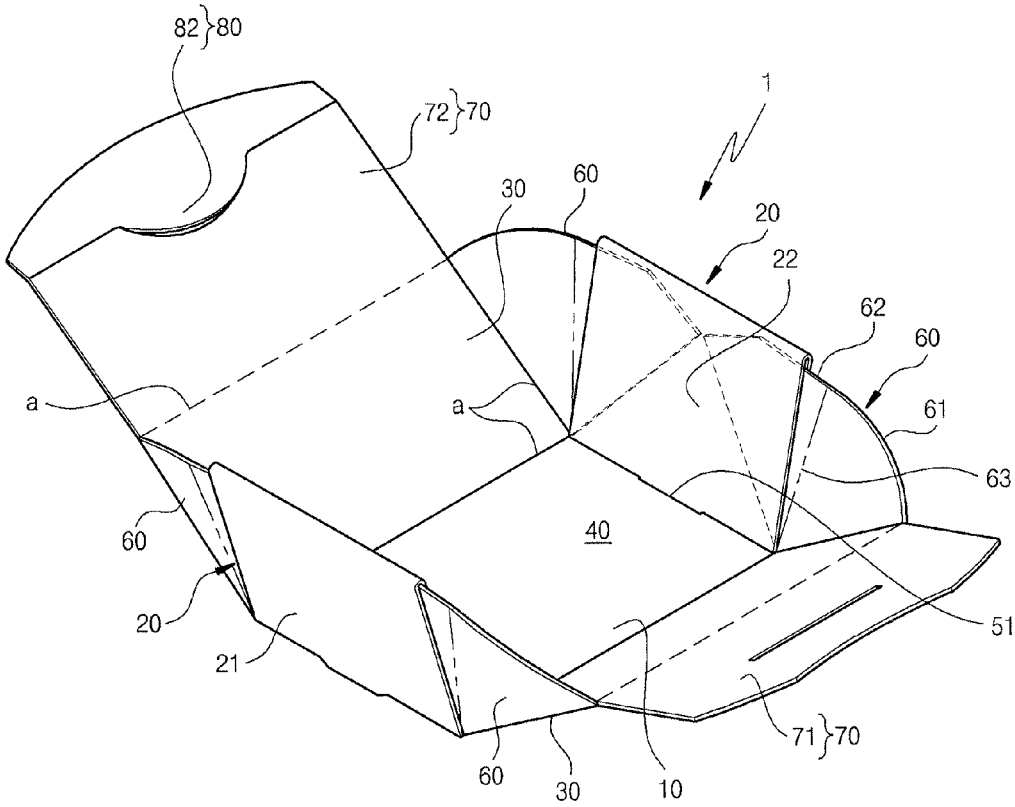
FIG. 5 is a perspective view illustrating the structure of the packing box of FIG. 1, in which the rotating sidewall members are rotated to be inclined.

Accordingly, the form of the accommodation space 40, which has an approximately rectangular parallelepiped shape when the rotating side wall members 30 stand upright as shown in FIG. 4, is changed with the volume thereof expanded by the space provided by the covering members 60 on both sides of the rotating side wall member 30 as the rotating side wall members 30 are rotated to be inclined outward. The accommodation space 40 may be expanded on one side by rotating one rotating sidewall member 30, or expanded on both sides by rotating the pair of rotating sidewall members 30 together to be distanced from each other. Thereby, the packing box 1 is converted into a vessel having an opening wider than the bottom of the accommodation space 40 as shown in FIG. 5.

Figure 3:
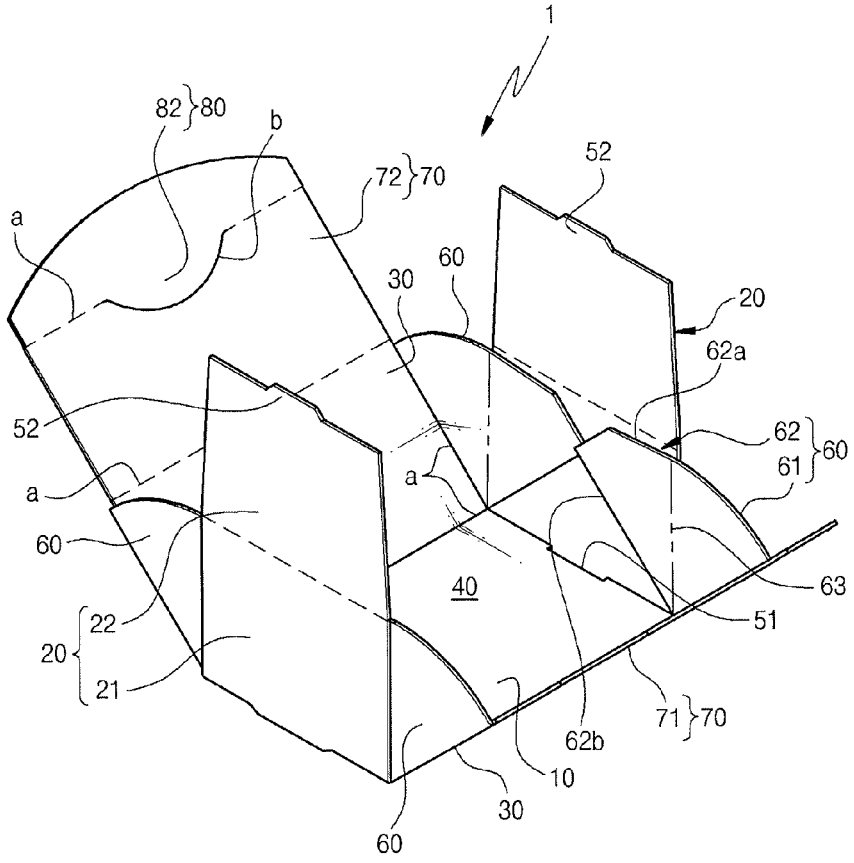
FIG. 3 is a perspective view illustrating the structure of the packing box of FIG. 1, in which the packing box is under assembly.

In the illustrated embodiment, the covering members 60 are bent at both lateral ends of the rotating sidewall member 30 and vertically extend therefrom toward the fixed sidewall members 20 in the form of a fan. As shown in FIG. 3, the covering members 60 disposed on both sides of the fixed side wall members 20 are arranged to overlap each other on the inner surface of the outer side wall member 21 before the inner side wall member 22 of the fixed side wall member 20 is folded toward the inner surface of the outer side wall member 21. When the inner sidewall member 22 is folded toward the outer sidewall member 21 in this state and the fixing protrusion 52 is fixed to the fixing hole 51, the covering members 60 are slidably coupled to the coupling portion 23 and are thus allowed to rotate together with the rotating sidewall members 30. The covering members 60 supported between the inner sidewall member 22 and the outer sidewall member 21 to slide during rotation of the rotating sidewall members 30 function to guide stable rotation of the rotating sidewall members 30.

If the rotating sidewall members 30 are rotated 90° from their vertical position to be parallel with the bottom member 10, the lateral sides of the accommodation space 40 are open and thus the accommodation space 40 hardly retains contents therein. On the other hand, if the inclination angle of the rotating sidewall members 30 is too small, the effect of expansion of the accommodation space 40 may be insufficient. Therefore, the inclination angle of the rotating sidewall members 30 may be limited to vary between about 30° and about 70°. In the illustrated embodiment, the maximum inclination angle of the rotating sidewall members 30 is 45°.

Also, to prevent the rotating sidewall members 30 from being separated from the fixed sidewall members 20, the covering member 60 is such that arranged such that movement thereof is stopped by the coupling portion 23 when the rotating sidewall members 30 are inclined to the maximum inclination angle.

Each of the covering members 60 includes a first part 61 directly connected to the rotating sidewall members 30, and a second part 62 extending from the first part 61. In the illustrated embodiment, the first and second parts 61 and 62 are arranged to occupy approximately half the area of the covering member 60. The first part 61 is formed in the shape of a fan, and the second part 62 also has a shape close to the form of a fan. The second part 62 is provided with a stopping portion 62*a* in the form of a straight line at a portion corresponding to the arc of a fan so as to be stably held by the upper boundary between the inner side wall member 22 and the outer side wall member 21 when the rotating side wall members 30 are inclined to the maximum inclination angle. The stopping portion 62*a* is arranged in an approximately horizontal direction and is thus stably held by the upper boundary between the outer sidewall member 22 and the inner sidewall member 21 when the rotating sidewall members 30 are inclined to the maximum inclination angle. Also, the covering member 60 is provided with a bottom supported portion 62*b* to be supported by the bottom member 10 when the rotating side wall members 30 are perpendicular to the bottom member 10 such that the rotating side wall members 30 standing upright are more stably supported.

Figure 6:
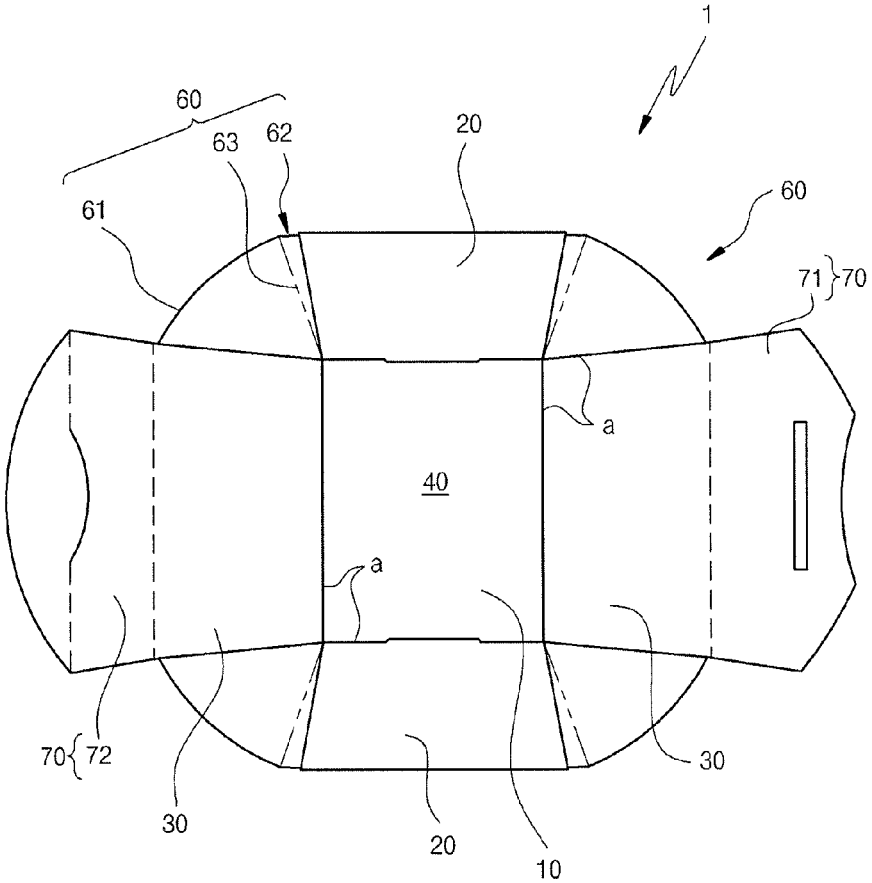
FIG. 6 is a plan view illustrating extension of fixed sidewall members of FIG. 5.

In addition, a folding guide line 63 to guide folding of the covering member 60 is provided at the center between the first part 61 and second part 62 of the covering member 60. Thereby, when the accommodation space 40 is expanded to the maximum and force is applied to the fixed side wall members 20 to widen the distance between the fixed side wall members 20, the packing box 1 is converted into a shape of a dish having a wide opening with the folding guide line 63 folded, as shown in FIG. 6.

The packing box 1 also includes a cover 70 to open and close the open top of the accommodation space 40, and a locking part 80 to lock the cover 70 with the accommodation space 40 closed.

The cover 70 is provided with a first cover 71 and a second cover 72 which extend from the upper portions of the rotating sidewall members 30 to be foldable. The first cover 71 and the second cover 72 are arranged such that the ends thereof overlap each other when the first cover 71 and the second cover 72 are folded to cover the top of the accommodation space 40. The locking part 80 includes a fitting hole 81 formed in the shape of a slot at the end of the first cover 71 to penetrate the first cover 71, and a fitting segment 82 arranged at the end of the second cover 72 to be laid on the fitting hole 81 to be fitted into and held by the fitting hole 81. The fitting segment 82 is adapted to protrude along the cut line b in the center of the folding line a when the second cover 72 is folded along the folding line a. As the fitting segment 82 is fitted into or removed from the fitting hole 81, the cover 70 is locked or unlocked.

Accordingly, when the cover 70 is locked through the locking part 80, the top of the accommodation space 40 is closed through the cover 70, and at the same time the rotating side wall members 30 remain connected to each other through the cover 70, and thereby the rotating movement of each rotating sidewall member 30 is limited. When the cover 70 is unlocked and thus the first and second covers 71 and 72 are disconnected from each other, the rotating sidewall members 30 are allowed to rotate.

Various modified forms such as male and female buttons and male and female Velcro may be provided for the locking part 80 to lock or unlock the cover 70 and at the same time to selectively limit rotating movement of the rotating sidewall members 30.

Hereinafter, a packing box 2 according to another embodiment of the present invention will be described.

As shown in FIGS. 9 to 13, the packing box 2 includes a rectangular bottom member 10, and four sidewall members 90 and 100 arranged to be erected at the perimeter of the bottom member 10. The inner space within the bottom member 10 surrounded by the four sidewall members 90 and 100 defines an accommodation space 40 with an open top to receive contents. The bottom member 10 may be formed in the shape of a square or a rectangle.

Figure 9:
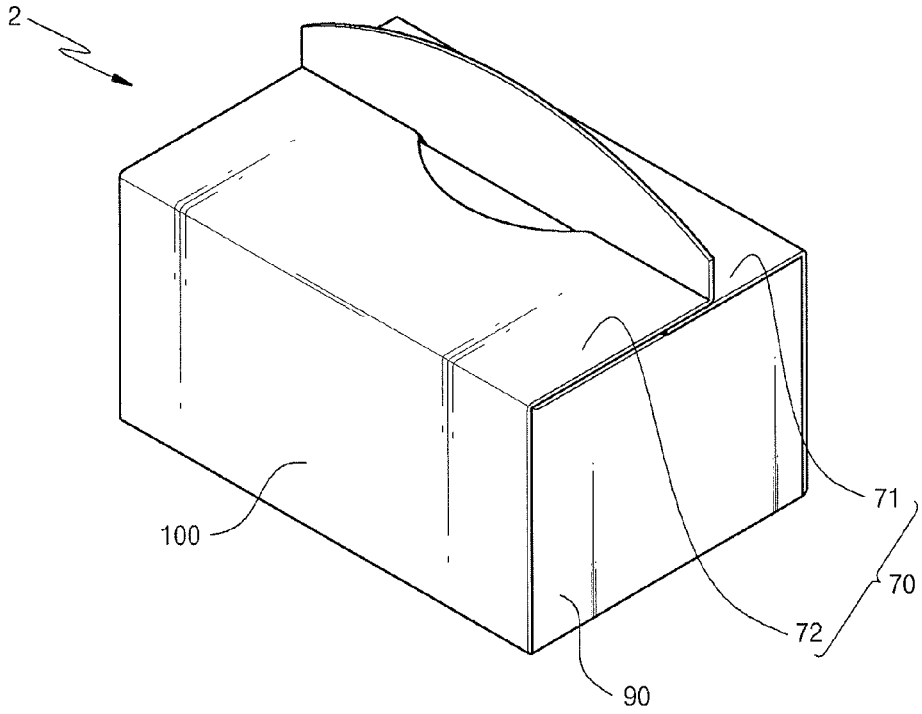
FIG. 9 is a perspective view of a structure of a packing box according to another embodiment of the present invention, in which an accommodation space of the packing box is closed.
Figure 10:
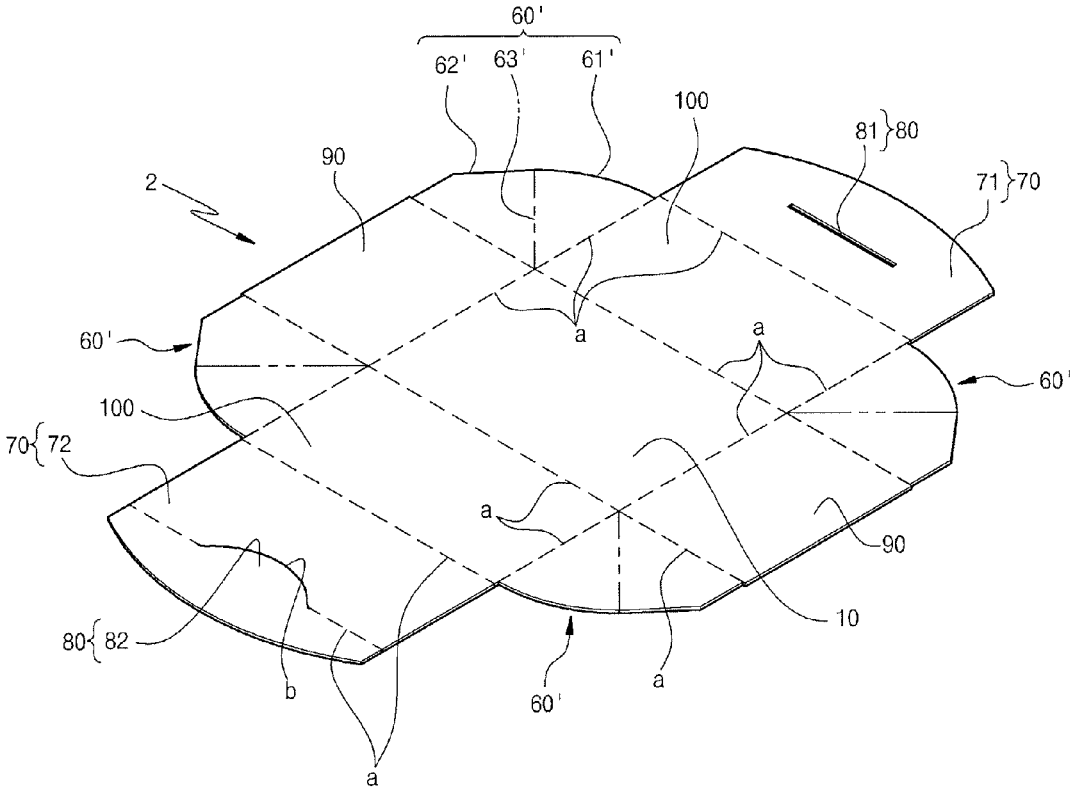
FIG. 10 is an exploded view illustrating the packing box of FIG. 9.

The packing box 2 of FIG. 9 is made by folding a sheet of paper cut in the form of an unfolded figure shown in FIG. 10.

The sidewall members 90 and 100 are divided into a pair of fixed sidewall members 90 disposed facing each other to be vertically erected and fixed, and a pair of rotating sidewall members 100 positioned facing each other between the fixed sidewall members 90 to be rotated around the lower ends thereof from the vertically erected positions and inclined outward.

The packing box 2 also includes a cover 70 to open and close the open top of the accommodation space 110, and a locking part 80 to lock the cover 70 with the accommodation space 110 closed. The cover 70 and locking part 80 may be arranged as in the previous embodiment.

In the illustrated embodiment, covering members 60' to cover the gap between the rotating sidewall members 100 rotated to change the accommodation space 110 and the fixed sidewall members 90 are provided to foldably connect the adjacent lateral ends of the rotating sidewall member 100 and the fixed side wall member 90 to each other.

Each of the covering members 60' is provided with a plurality of foldable members 61' and 62' adapted to overlap each other when the rotating sidewall members 100 are arranged perpendicular to the bottom member 10. The foldable members 61' and 62' exhibit elastic resilience to be spaced from each other when external force is not applied thereto.

A folding line 63' is provided between the foldable members 61' and 62'. To facilitate maintaining the erected position of the fixed sidewall members 90, a foldable member 61' disposed closest to the rotating sidewall member 100 among a plurality of foldable members 61' and 62' is bonded and fixed to the inner surface of the rotating sidewall member 100.

Figure 11:
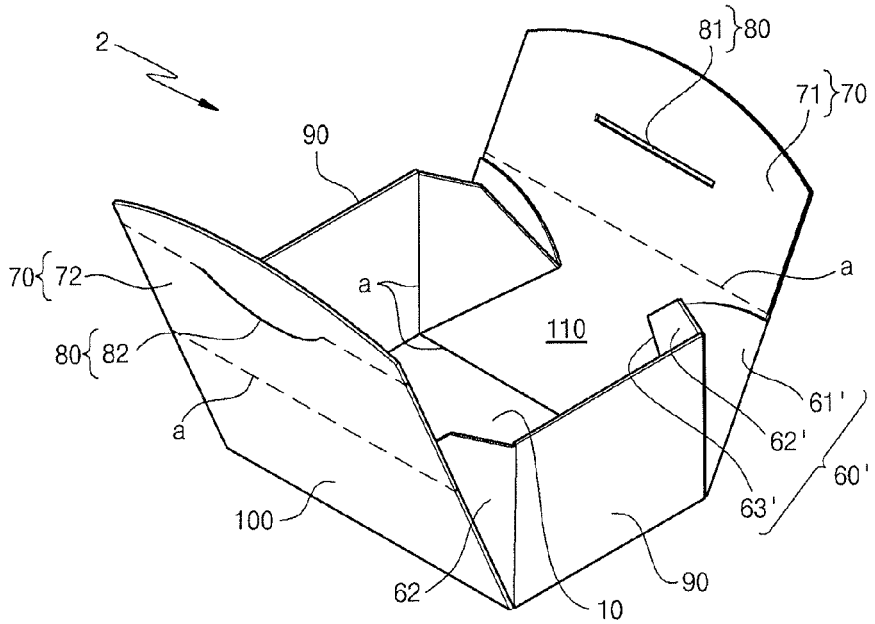
FIG. 11 is a perspective view illustrating the structure of the packing box of FIG. 9, in which rotating sidewall members are rotated to be inclined.

Therefore, for the packing box 2 provided as above, when the cover 70 in the position shown in FIG. 9 is unlocked such that the first and second covers 71 and 72 are separated from each other, the distance between the rotating side wall members 100 is automatically widened as the gap between the foldable members 61' and 62' of the covering member 60 is elastically widened as shown in FIG. 11. Thereby, the packing box 2 is converted into a vessel having an opening wider than the bottom of the accommodation space 110. Even in this situation, the space between the fixed sidewall member 90 and the rotating sidewall member 100 remains closed by the covering member 60'.

Figure 12:
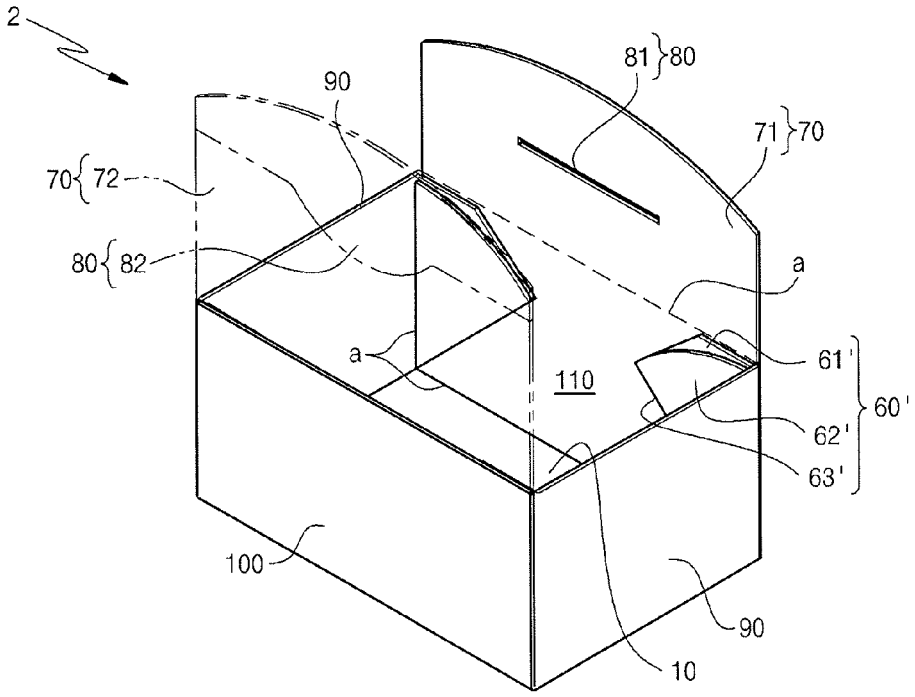
FIG. 12 is a perspective view illustrating the structure of the packing box of FIG. 9, in which the rotating sidewall members are vertically erected.
Figure 13:
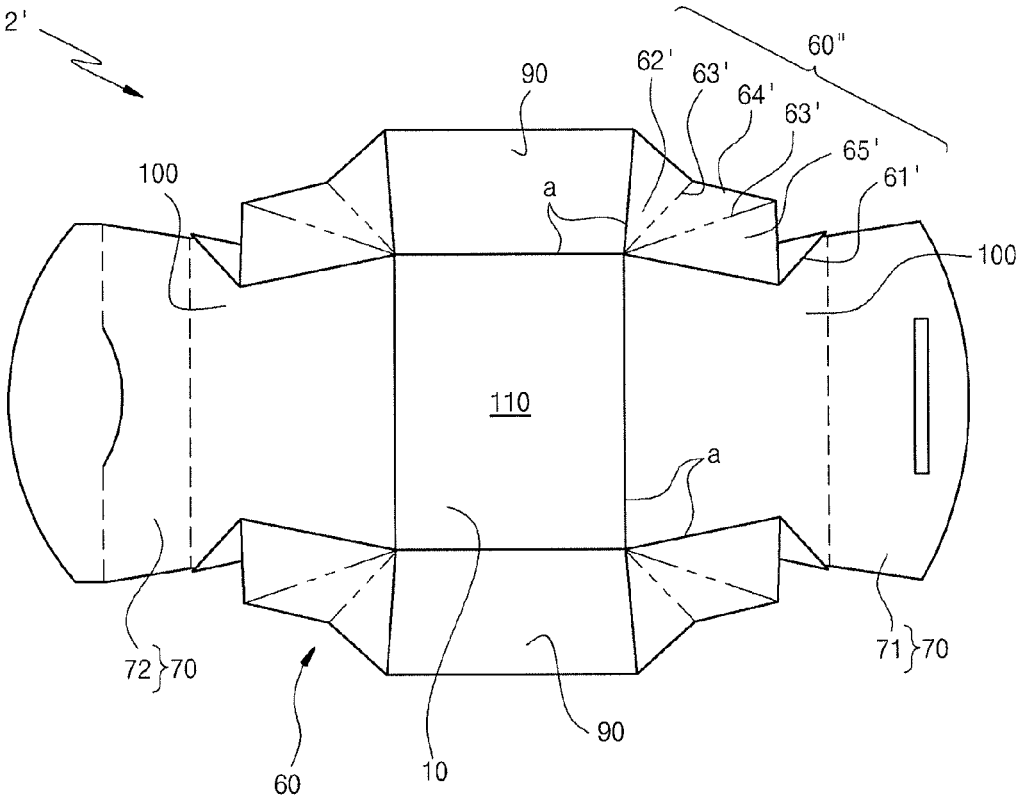
FIG. 13 is a plan view illustrating a modification of the packing box of FIG. 9, in which the rotating sidewall members are rotated to be inclined.

When the widened distance between the rotating sidewall members 100 as above is narrowed by applying force to the rotating sidewall members 100, the foldable members 61' and 62' of the covering member 60' move to closely contact each other and the rotating sidewall members 10 are again vertically erected, as shown in FIG. 12. When the cover 70 is locked again using the locking part 80 in this state, the packing box recovers the shape shown in FIG. 1.

In the illustrated embodiment, two foldable members 61' and 62' are provided. However, in a modified embodiment of a packing box 2' shown in FIG. 13, two or more foldable members 61', 62', 64' and 65' may be provided. As the number of foldable members 61', 62', 64' and 65' increases, the fixed sidewall members 90 of the packing box 2' may also remain inclined outward to some extent.

As is apparent from the above description, the packing box is provided with a pair of rotating sidewall members disposed facing each other and adapted to be inclined outside the bottom member, and the gap between the inclined rotating sidewall member and an adjacent fixed sidewall member is closed by a covering member.

Accordingly, the size of the accommodation space of the packing box may be easily varied through the rotating sidewall members and the covering members, and therefore use of contents contained in the accommodation space may be facilitated without using a separate vessel.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A packing box including a rectangular bottom member and four sidewall members adapted to be erected at an outer perimeter of the bottom member and thereby defining an accommodation space having an open top, wherein the sidewall members are divided into a pair of fixed sidewall members disposed facing each other to be vertically erected and fixed, and a pair of rotating sidewall members disposed facing each other between the fixed sidewall members to be inclined to an outside of the bottom member with respect to a vertical position thereof, each of said fixed sidewall members comprising an outer sidewall member bent upward to vertically extend from the bottom member, and an inner sidewall member bent to extend from an end of the outer sidewall member to be folded toward an inner surface of the outer sidewall member, wherein:

a fixing hole is provided between the outer sidewall member and the bottom member;

a fixing protrusion is provided at an end of the inner sidewall member to be fixed to the fixing hole; and the fixed sidewall member is provided with a coupling portion, the coupling portion being arranged between the outer sidewall member and the inner sidewall member;

the packing box further comprising at least one covering member to cover a gap between the fixed sidewall member and the rotating sidewall member when the rotating sidewalls are inclined, said covering member being arranged to be vertically bent and extend from a lateral end of the rotating sidewall member toward the fixed sidewall member; and slidably coupled to the coupling portion, the covering member further being adapted to be stopped by the coupling portion when the rotating sidewall member is inclined to a maximum inclination angle.

2. The packing box according to claim 1, wherein an end of the fixing protrusion penetrates the fixing hole and is bent to one side.

3. The packing box according to claim 1, wherein the covering member comprises a first part directly connected to the rotating sidewall member and a second part extending from the first part, wherein the second part comprises a stopping portion adapted to be held at an upper boundary between the inner sidewall member and the outer sidewall member when the rotating sidewall member is inclined to the maximum inclination angle.

4. The packing box according to claim 3, wherein the second part further comprises a bottom supported portion adapted to be supported by the bottom member when the rotating sidewall member is arranged perpendicular to the bottom member.

5. The packing box according to claim 3, wherein a folding guide line to guide folding of the covering member may be provided between the first part and second part of the covering member.

* * * * *